US006350143B2

(12) United States Patent
Kato et al.

(10) Patent No.: US 6,350,143 B2
(45) Date of Patent: Feb. 26, 2002

(54) ON-BOARD UNIT RECEIVING CONNECTOR POSITIONING STRUCTURE

(75) Inventors: Katsutoshi Kato; Kensaku Takata, both of Nagoya (JP)

(73) Assignees: Autonetworks Technologies, Ltd., Aichi; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/793,494

(22) Filed: Feb. 27, 2001

(30) Foreign Application Priority Data

Mar. 1, 2000 (JP) ..... 12-055647

(51) Int. Cl.[7] ..... H01R 13/64
(52) U.S. Cl. ..... 439/374; 439/377; 439/297
(58) Field of Search ..... 439/374, 377, 439/297, 34

(56) References Cited

U.S. PATENT DOCUMENTS 4,797,786 A * 1/1989 Belanger, Jr. ..... 439/377
4,812,133 A 3/1989 Fleak et al.

* cited by examiner

*Primary Examiner*—Tho D. Ta
(74) *Attorney, Agent, or Firm*—Oliff & Berridge, PLC

(57) ABSTRACT

In the guide ribs 2*b* of the meter unit 2 and the guide rail grooves 3*b* of the insertion opening 3 of the center cluster panel 1, there are formed play restrict portions 2*c*, 2*d* as well asb 3*c*, 3*d* respectively for restricting the movements of the guide ribs 2*b* from the time just before the mutual fitting engagement of the terminals of the two connectors 4A and 4B to the time just after the mutual connection of the two connectors 4A and 4B. Due to this, from the time just before the mutual fitting engagement of the terminals of the two connectors 4A and 4B to the time during the mutual connection of the two connectors 4A and 4B, the inclination of the meter unit 2 can be reduced by setting the positioning accuracy in this range equivalent to the fitting accuracy of the terminals of the two connectors 4A and 4B. This eliminates a fear that an excessive force can be applied to the two connectors 4A and 4B while they are fitted with each other.

4 Claims, 4 Drawing Sheets

CONVENTIONAL ART

ON-BOARD UNIT RECEIVING CONNECTOR POSITIONING STRUCTURE

BACKGROUND OF THE INVENTION

1. Field of the Invention

The present invention relates to a structure for positioning a connector for receiving an on-board unit.

2. Related Art

As a structure in which, in a car-body side panel, there is formed an insertion opening into which an on-board unit can be inserted, for example, as shown in FIGS. 3 and 4, there is known a structure in which, in a center cluster panel (car-body side panel) 1 which is so interposed between the front portion of a center console box of a car and the front portion of an instrument panel of the car as to straddle these two front portions, there is formed an insertion opening 3 in such a manner that it is situated in front of the driver's seat of the car and also that a meter unit (an on-board unit) 2 can be inserted into the insertion opening 3.

And, on the upper portion of the insertion opening 3, there is mounted a backward-facing receiving connector 4A and, at the same time, on the upper portion of the meter unit 2, there is mounted a forward-facing connector 4B which, as shown in FIG. 4B, can be connected to the receiving connector 4A when the meter unit 2 is inserted into the insertion opening 3 of the center cluster panel 1 (see an arrow mark A shown in FIG. 4A).

In the above-mentioned on-board unit receiving connector structure, in order to be able to absorb molding errors and assembling errors, it is necessary to set a relatively large clearance (play) between the outer surface of the meter unit 2 and the inner surface of the insertion opening 3, which resulting in the no-positioning of the two connectors 4A and 4B. Therefore, in some cases, it is difficult to connect the connector 4B, which is disposed on the meter unit 2 side, to the receiving connector 4A which is disposed on the center cluster panel 1 side.

In view of the above, as shown in FIG. 5, at the right and left positions of the outer surface of the meter unit 2, there are disposed straight-shaped guide ribs 2*a* and, at the same time, at the right and left positions of the inner surface of the insertion opening 3 of the center cluster panel 1, there are formed straight-shaped guide rail grooves 3*a:* and, in operation, when the guide ribs 2*a* are respectively fitted into their associated guide rail grooves 3*a* to thereby insert the meter unit 2 into the insertion opening 3 (see an arrow mark A shown in FIG. 5), the positioning of the two connectors 4A and 4B can be guided. That is, there is provided a device which can facilitate the connection of the connector 4B disposed on the meter unit 2 side to the receiving connector 4A disposed on the center cluster panel 1 side.

(Problems to be Solved by the Invention)

However, in the positioning guiding structure simply using the straight-shaped guide ribs 2*a* and guide rail grooves 3*a,* the positioning accuracy thereof is poor when compared with the fitting accuracy of the two connectors 4A and 4B. Due to this, in case where the meter unit 2 is inclined in the inserting operation thereof when the former is inserted into the latter, there is a fear that an excessive force can be applied to the connectors 4A and 4B while they are fitted with each other.

Also, in case where the position displacement of the meter unit 2 side connector 4B with respect to the center cluster panel 1 side receiving connector 4A is absorbed by the displacement of the receiving connector 4A, there is a fear that, due to the additional provision of such displacement mechanism, the receiving connector 4A can be increased in size.

SUMMARY OF THE INVENTION

The present invention aims at eliminating the above-mentioned problems found in the conventional on-board unit receiving connector positioning structures. Accordingly, it is an object of the invention to provide an improved on-board unit receiving connector positioning structure which not only can prevent an excessive force from being applied to connectors during the mutually fitted state thereof but also can prevent a receiving connector from being increased in size.

(Means for Solving the Problems)

In attaining the above object, according to a first aspect of the invention, there is provided an on-board unit receiving connector positioning structure, comprising: an insertion opening formed in a car-body side panel in such a manner that an on-board unit can be inserted into the insertion opening; a receiving connector mounted in the insertion opening; and, a connector disposed on the on-board unit in such a manner that, the on-board unit is inserted into the insertion opening of the car-body side panel, the connector can be connected to the receiving connector, wherein, in the inner surface of the insertion opening of the car-body side panel as well as in the outer surface of the on-board unit, there are disposed guide ribs and guide rail grooves in such a manner that they correspond in position to each other and can be fitted with each other to thereby be able to position the two connectors, and, in the guide ribs and guide rail grooves, there are respectively formed play restrict portions for restricting the play of the guide ribs and guide rail grooves from the time just before the terminals of the two connectors are fitted with each other to the time just after the two connectors are connected together.

According to the first aspect of the invention, not only the guide rail grooves (or guide ribs) are disposed in the inner surface of the insertion opening of the car-body side panel and the guide ribs (or guide rail grooves) are disposed on the outer surface of the on-board unit but also, in these guide ribs and guide rail grooves, there are formed the play restrict portions for respectively restricting the play of the guide ribs and guide rail grooves from the time just before the terminals of the receiving connector of the car-body side panel and the connector of the car-body side panel are fitted with each other to the time just after the these two connectors are connected together. Thanks to this, when inserting the on-board unit into the insertion opening of the car-body side panel, in case where the guide ribs (or guide rail grooves) are respectively inserted into their associated guide rail grooves (or guide ribs) to thereby position the two connectors, the positioning accuracy in the above range can be set equivalent to the fitting accuracy of the terminals of the two connectors and thus the inclination of the on-board unit in the inserting operation thereof can be reduced. This can eliminate a fear that an excessive force can be applied to the two connectors while they are fitted with each other.

Also, in the other portions than the above-mentioned range, the guide ribs and guide rail grooves are allowed to play positively, so that the inserting operation of the on-board unit into the insertion opening can be executed relatively smoothly. This can facilitate the connection of the on-board unit side connector with respect to the car-body side panel side receiving connector. Also, since the position displacement of the on-board unit side connector with respect to the car-body side panel side receiving connector can be absorbed by the displacement of the on-board unit due to the play of the guide ribs and guide rail grooves, the displacement absorption amount of the receiving connector can be reduced, which can prevent the receiving connector from being increased in size.

Also, according to a second aspect of the invention, there can also be provided the following structure in which, in an on-board unit receiving connector positioning structure as set forth in the first aspect of the invention, at the right and left positions of the outer surface of the on-board unit, there are provided guide ribs; at the right and left positions of the inner surface of the insertion opening of the car-body side panel, there are formed guide rail grooves; on the front and rear sides of each of the guide rail grooves, there is formed a play restrict portion having a narrow clearance in the vertical direction thereof; between the front and rear play restrict portions, there is formed a play portion having a wide clearance in the vertical direction thereof; and, in the intermediate portion of each of the guide ribs, there is formed a narrow width portion which, when the rear portion of the guide rib is inserted into its associated play portion after connection of said two connectors, allows the rear portion of the guide rib to play in the vertical direction with the front portion of the guide rib fitted into the front-side play restrict portion of its associated guide rail groove as a fulcrum.

Further, in addition to the structure according to the second aspect of the invention, according to a third aspect of the invention, preferably, there may be provided the following structure in which, in an on-board unit receiving connector positioning structure as set forth in the first or second aspect of the invention, at least at one of the upper and lower positions of the outer surface of the on-board unit, there is disposed a guide rib; in the inner surface of the insertion opening of the car-body side panel, there is formed a guide rail groove which corresponds in position to the guide rib; on the front and rear portions of said guide rail groove, there are formed play restrict portions each having a narrow clearance in the right and left direction; between the front and rear play restrict portions, there is formed a play portion having a wide clearance in the right and left direction; and, in the intermediate portion of the guide rib, there is formed a narrow width portion which, when the rear portion of the guide rib is inserted into the play portion after connection of the two connectors, allows the rear portion of the guide rib to play in the right and left direction with the front portion of the guide rib fitted into the front-side play restrict portion of the guide rail groove as a fulcrum.

BRIEF DESCRIPTION OF THE DRAWINGS

FIG. 2A is a section view of two connectors, showing a state thereof before they are connected together; FIG. 2B is a section of the terminals of the two connectors, showing a state thereof just before they are connected together; and, FIG. 2C is a section view of two connectors, showing a state thereof after they are connected together;

DETAILED DESCRIPTION OF THE PREFERRED EMBODIMENTS (Mode for Carrying Out the Invention)

Now, description will be given below in detail of an embodiment of a structure for positioning an on-board unit receiving connector with reference to the accompanying drawings. By the way, the parts of the present embodiment that are the same as those of the above-mentioned conventional structure in structure and operation are given the same designations, and thus the detailed description thereof is omitted here.

Figure 1:
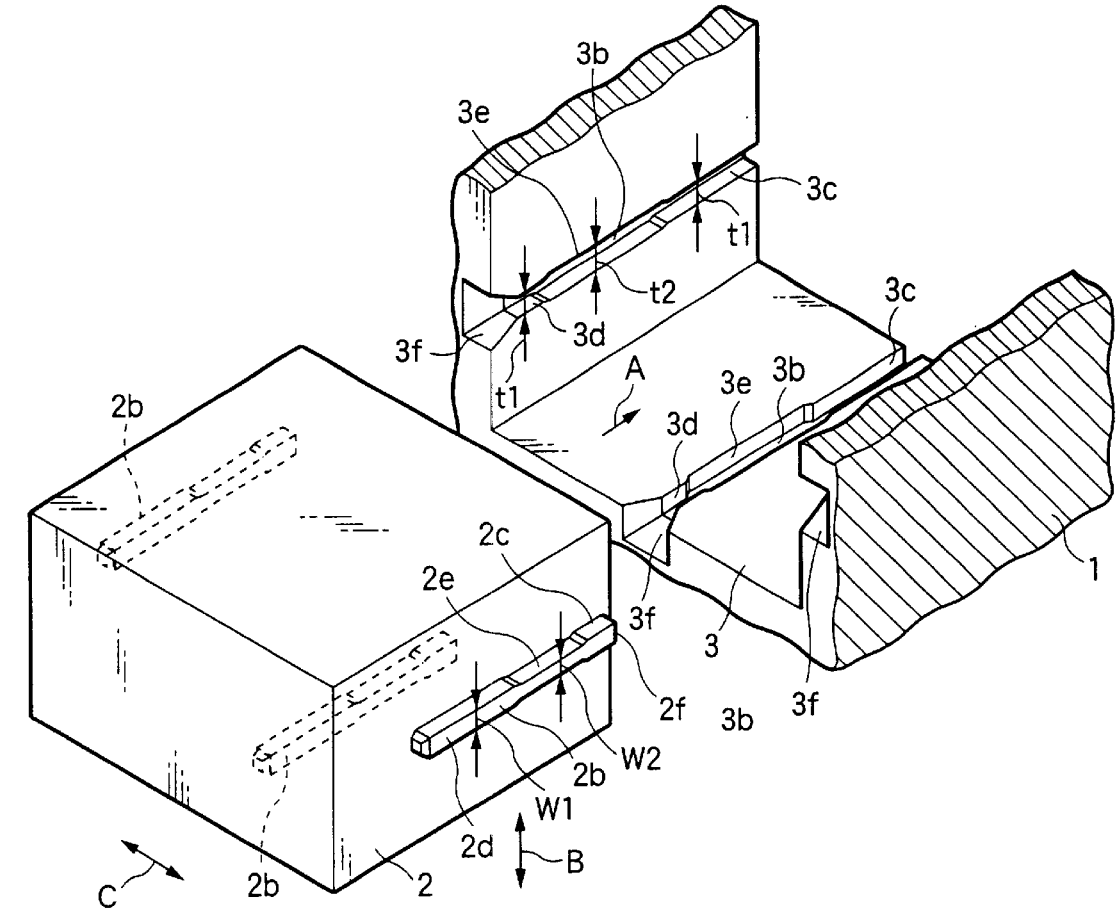
FIG. 1 is a perspective view of an embodiment of an onboard unit receiving connector positioning structure according to the invention.
Figure 2A:
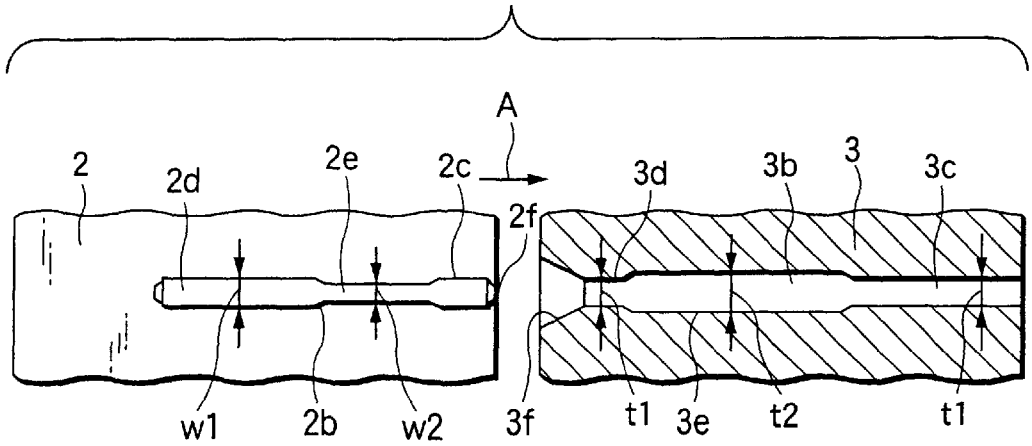
FIGS. 2A to 2C show a positioning procedure according to the invention.
Figure 2B:
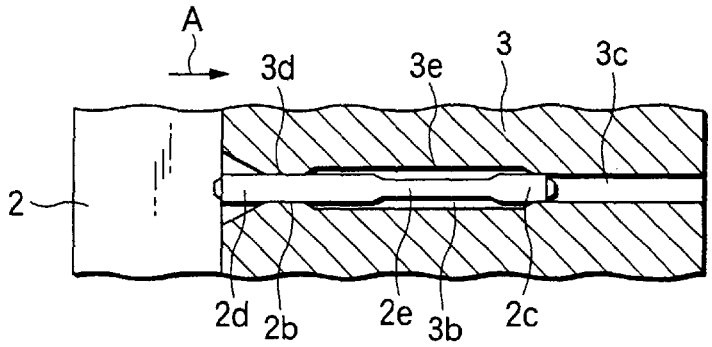

As shown in FIGS. 1 and 2, at two right and left positions as well as at a lower position of the outer surface of a meter unit 2 on which there is mounted a connector 4B, there are disposed straight-shaped guide ribs 2*b* respectively; and, similarly, at two right and left positions as well as at a lower position of the inner surface of an insertion opening 3 on which there is mounted a receiving connector 4A of a center cluster panel 1, there are formed straight-shaped guide rail grooves 3*b* respectively. By the way, in the entrance end portions of the guide rail grooves 3*b,* which are situated on the rear side of the guide rail grooves 3*b,* there are formed chamfered portions 3*f* respectively; and, in the fitting ends of the guide ribs 2*b,* which are situated on the front side of the guide ribs 2*b,* there are formed chamfered portions 2*f* respectively.

And, basically, similarly to the previously described conventional on-board unit receiving connector positioning structure, in case where the guide ribs 2*b* are respectively fitted into their associated guide rail grooves 3*b* to thereby insert the meter unit 2 into the insertion opening 3 (see an arrow mark A shown in FIGS. 1 and 2), the positioning of the two connectors 4A and 4B can be guided, thereby being able to facilitate the connection of the connector 4B disposed on the meter unit 2 side to the receiving connector 4A disposed on the center cluster panel 1 side.

On the other hand, on the front (deep) and rear (entrance) sides of the respective guide rail grooves 3*b,* there are formed play restrict means 3*c,* 3*d* each having a narrow vertical-direction clearance t1 so that the guide ribs 2*b* each having a given width w1 can be fitted into their associated guide rail grooves 3*b* with almost no clearance between them from the time just before the mutual connection of the terminals of the two connectors 4A and 4B to the time just after the mutual connection of the two connectors 4A and 4B.

Figure 2C:
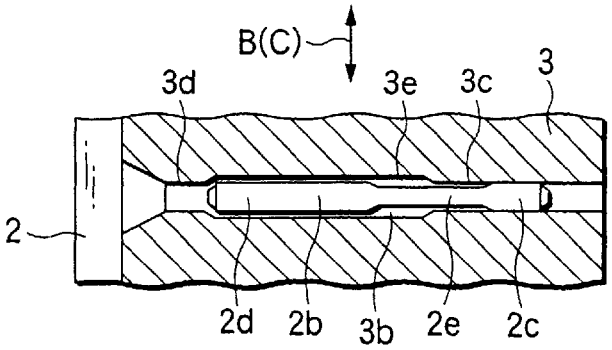
Figure 3:
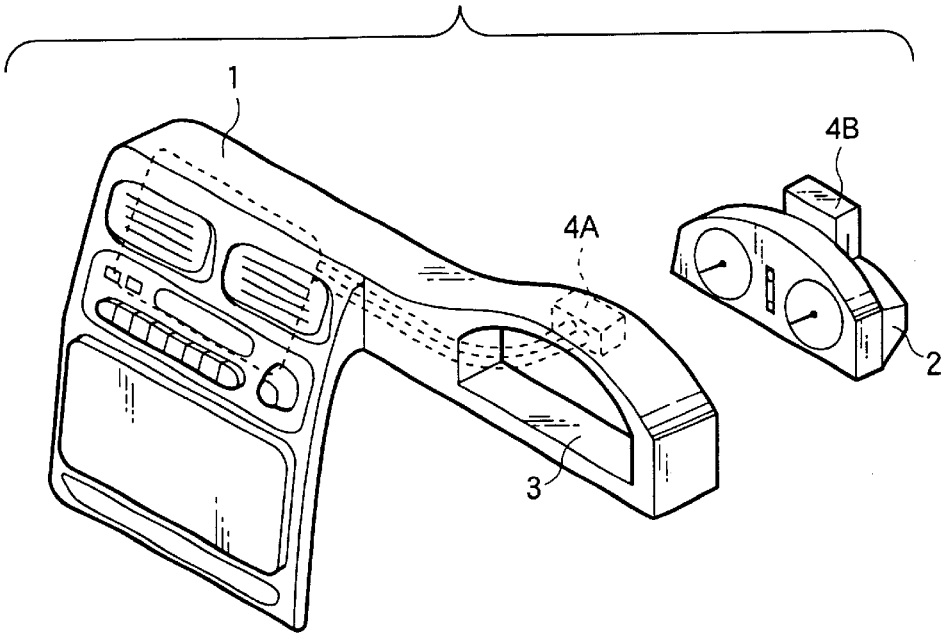
FIG. 3 is a perspective view of a center cluster panel and a meter unit.
Figure 4A:
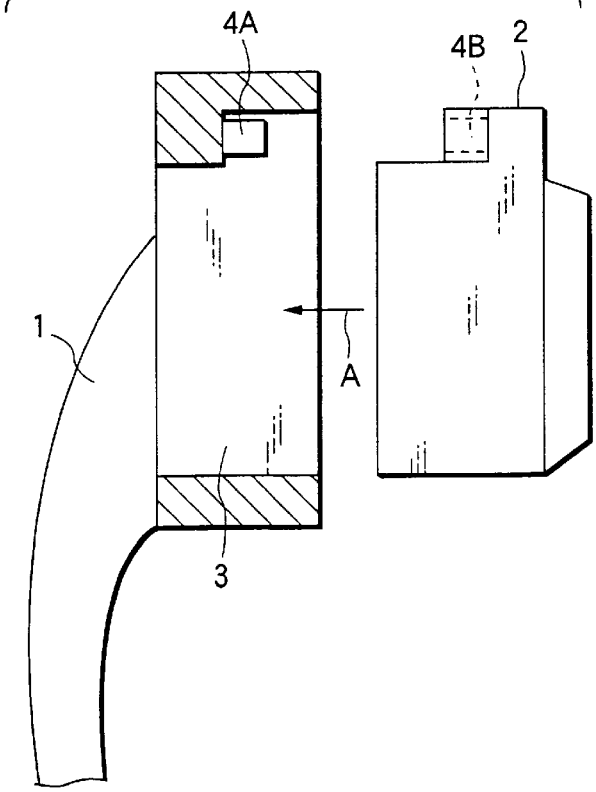
FIG. 4A is a section view of connectors, showing a state thereof before being connected together; and, FIG. 4B is a section view of the connectors, showing a state thereof after they are connected together.
Figure 4B:
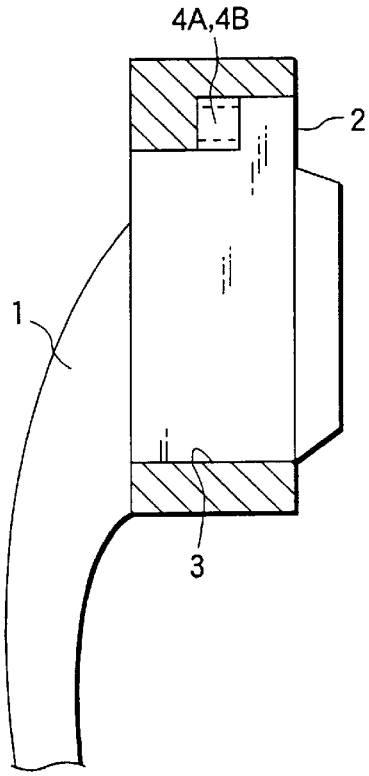
Figure 5:
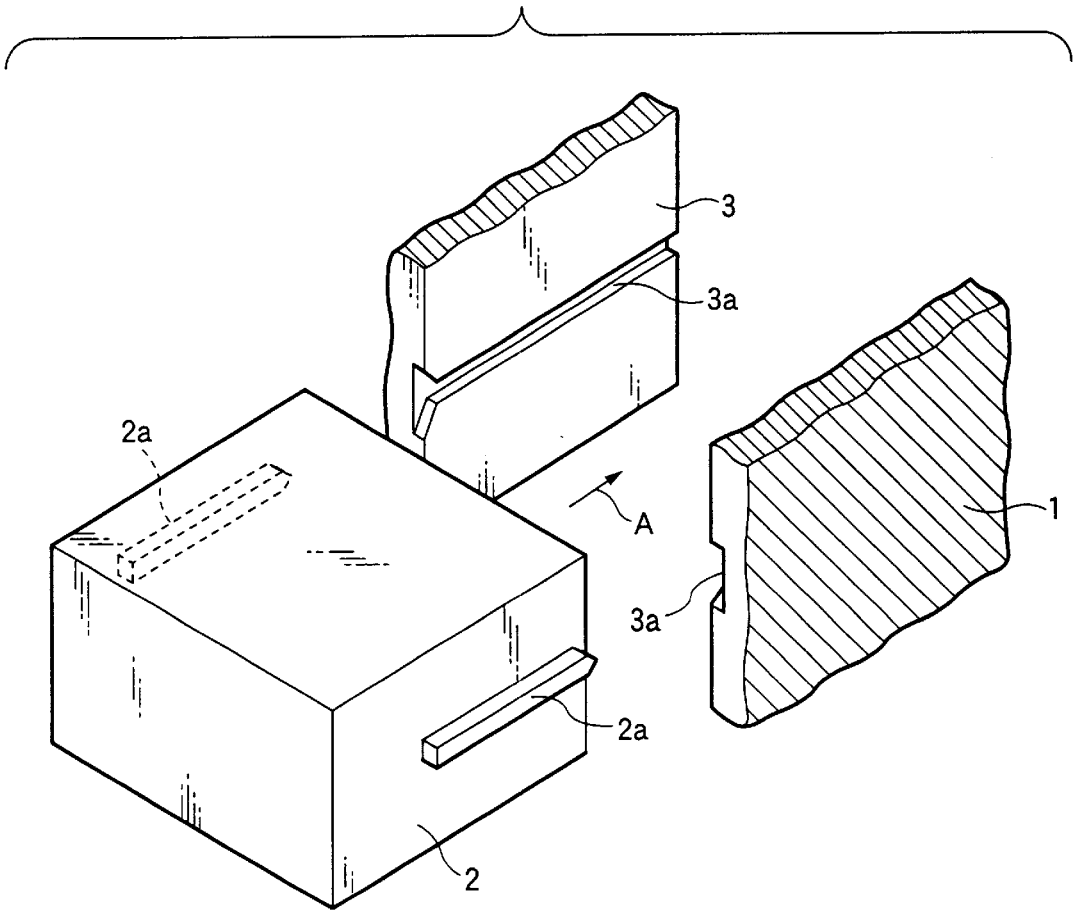
FIG. 5 is a perspective view of a conventional on-board unit receiving connector positioning structure.

And, between the right and left positioned front and rear play restrict portions 3*c* and 3*d,* there is formed a wide play portion 3*e* having a wide vertical-direction clearance t2 so that, when the rear portion 2*d* of the guide rib 2*b* having a given width w1 is inserted into its associated guide rail groove 3*b,* it is allowed to play in the vertical direction B (see FIGS. 1 and 2C); and, between the downwardly positioned front and rear play restrict portions 3*c* and 3*d,* there is formed a wide play portion 3*e* having a wide right-and-left-direction clearance t2 so that, when the rear portion 2*d* of the guide rib 2*b* having a given width w1 is inserted into its associated guide rail groove 3*b,* it is allowed to play in the right and left direction C (see FIGS. 1 and 2C).

Also, in the intermediate portion of the meter unit 2 that exists between the front portion (deep side) 2*c* and rear portion (entrance side) 2*d* of each of the right and left position guide ribs 2*b,* there is formed a narrow width portion 2*e* having a width w2 so that, when the rear portion 2*d* of the guide rib 2*b* is inserted into the play portion 3*e* just after the two connectors 4A and 4B are connected together, the rear portion 2*d* of the guide rib 2*b* is allowed to play in the vertical direction B with the front portion 2*c* of the guide rib 2*b* fitted into the front-side play restrict portion 3*c* of the guide rail groove 3*b* as a fulcrum thereof; and, in the intermediate portion of the meter unit 2 that exists between the front portion (deep side) 2*c* and rear portion (entrance side) 2*d* of the lower position guide rib 2*b,* there is formed a narrow width portion 2*e* having a width w2 so that, when the rear portion 2*d* of the guide rib 2*b* is inserted into the play portion 3*e* just after the two connectors 4A and 4B are connected together, the rear portion 2*d* of the guide rib 2*b* is allowed to play in the right and left direction C with the front portion 2*c* of the guide rib 2*b* fitted into the front-side play restrict portion 3*c* of the guide rail groove 3*b* as a fulcrum thereof.

In case where an on-board unit receiving connector positioning structure is constructed in the above-mentioned manner, in the guide ribs 2*b* of the meter unit 2 and the guide rail grooves 3*b* of the insertion opening 3 of the center cluster panel 1, there are formed the front and rear portions 2*c,* 2*d,* which are play restrict portions, as well as play restriction portions 3*c,* 3*d* respectively for restricting the movements of the guide ribs 2*b* from the time just before the mutual connection of the terminals of the two connectors 4A and 4B to the time just after the mutual connection of the two connectors 4A and 4B. Thanks to this, when, by fitting the guide ribs 2*b* of the meter unit 2 into the guide rail grooves 3*b* of the insertion opening 3, the positioning of the two connectors 4A and 4B in inserting the meter unit 2 into the insertion opening 3 is guided, the positioning accuracy in this range can be set equivalent to the fitting accuracy of the terminals of the two connectors 4A and 4B, so that the inclination of the meter unit 2 can be reduced; and, therefore, there is eliminated a fear that an excessive force can be applied to the two connectors 4A and 4B while they are fitted with each other, thereby avoiding a fear that the two connectors 4A and 4B can be damaged.

Also, in the other portions than the above-mentioned range, the guide ribs 2*b* are allowed to play positively, so that the inserting operation of the meter unit 2 into the insertion opening 3 can be executed relatively smoothly. This can facilitate the connection of the connector 4B of the meter unit with respect to the receiving connector 4A of the insertion opening 3.

And, when the rear portions 2*d* of the guide ribs 2*b* are inserted into their associated play portions 3*e* after the mutual connection of the two connectors 4A and 4B, since the rear portions 2*d* of the guide ribs 2*b* are respectively allowed to play in the vertical direction B as well as in the right and left direction C with the front portions 2*c* of the guide ribs 2*b* fitted into the front-side play restrict portions 3*c* of the guide rail grooves 3*b* as the fulcrums thereof (see FIG. 2C), the position displacement of the connector 4B of the meter unit 2 with respect to the receiving connector 4A of the center cluster panel 1 can be absorbed by means of the displacement of the meter unit 2 due to such play of the rear portions 2*d* of the guide ribs 2*b* to thereby reduce the displacement absorption amount of the connector 4B, which can prevent the receiving connector 4B from being increased in size: that is, the receiving connector 4B can be made compact.

In the present embodiment, as mentioned above, the guide rail grooves 3*b* are formed in the insertion opening 3 of the center cluster panel 1 and the guide ribs 2*b* are disposed on the meter unit 2. However, alternatively, the guide ribs may be disposed on the insertion opening 3 of the center cluster panel 1 and the guide rail grooves may be formed in the meter unit 2. Also, in the present embodiment, although the guide rail grooves 3*b* and guide ribs 2*b* are respectively disposed at the right and left positions as well as the lower positions of the insertion opening 3 and meter unit 2, such guide rail grooves 3*b* and guide ribs 2*b* may also be disposed at the upper positions of the insertion opening 3 and meter unit 2.

Also, in the present embodiment, for the purpose of correspondence to the conventional on-board unit receiving connector positioning structure, the meter unit (on-board unit) 2 is inserted into the insertion opening 3 of the center cluster panel 1 from behind. However, alternatively, the meter unit 2 may also be inserted into the insertion opening 3 of the center cluster panel 1 from ahead.

Further, in the present embodiment, there is provided the receiving connectors 4A, 4B positioning structure which is used when the meter unit 2 is inserted into the insertion opening 3 of the center cluster panel 1 of a car. However, this is not limitative but, of course, the invention can also apply to a receiving connector positioning structure which is used when any of various units such as audio equipment (a car radio set, a CD player), a NAVI (a car navigation system), an air conditioner, a lamp is inserted the insertion opening of the center cluster panel of a car.

(Effects of the Invention)

As can be understood clearly from the foregoing description, according to the invention, not only the guide rail grooves (or guide ribs) are disposed in the inner surface of the insertion opening of the car-body side panel and the guide ribs (or guide rail grooves) are disposed on the outer surface of the on-board unit but also, in these guide ribs and guide rail grooves, there are formed the play restrict portions for respectively restricting the play of the guide ribs and guide rail grooves from the time just before the terminals of the receiving connector of the car-body side panel and the connector of the car-body side panel are fitted with each other to the time just after the these two connectors are connected together. Thanks to this, when inserting the on-board unit into the insertion opening of the car-body side panel, in case where the guide ribs (or guide rail grooves) are respectively inserted into their associated guide rail grooves (or guide ribs) to thereby position the two connectors, the positioning accuracy in the above range can be set equivalent to the fitting accuracy of the terminals of the two connectors and thus the inclination of the on-board unit in the inserting operation thereof can be reduced. This can eliminate a fear that an excessive force can be applied to the two connectors while they are fitted with each other.

Also, in the other portions than the above range, the guide ribs are allowed to play positively, so that the inserting operation of the on-board unit into the insertion opening can be executed relatively smoothly. This can facilitate the connection of the on-board unit side connector with respect to the car-body side panel side receiving connector. Also, since the position displacement of the on-board unit side connector with respect to the car-body side panel side receiving connector can be absorbed by the displacement of the on-board unit due to the play of the guide ribs, the displacement absorption amount of the receiving connector can be reduced, which can prevent the receiving connector from being increased in size; that is, the receiving connector can be made compact.

What is claimed is:

1. An on-board unit receiving connector positioning structure, comprising:

an insertion opening formed in a car-body side panel in such a manner that an on-board unit can be inserted into said insertion opening;

a receiving connector mounted in said insertion opening; and a connector disposed on said on-board unit, wherein when said on-board unit is inserted into said insertion opening of said car-body side panel, said connector can be connected to said receiving connector, and wherein in the inner surface of said insertion opening of said car-body side panel as well as in the outer surface of said on-board unit, guide ribs and guide rail grooves are respectively disposed to correspond in position to each other and to be fitted with each other so as to be able to position said two connectors, and in said guide ribs and said guide rail grooves, play restrict portions are respectively formed for restricting the play of said guide ribs and said guide rail grooves from the time just before the terminals of said two connectors are fitted with each other to the time just after said two connectors are connected together.

2. The on-board unit receiving connector positioning structure as set forth in claim 1, wherein at least one of the guide ribs is disposed at least at one of the upper and lower positions of the outer surface of said on-board unit;

at least one of the guide rail grooves that corresponds in position to the at least one of the guide ribs is formed in the inner surface of the insertion opening of said car-body side panel;

the play restrict portions each having a narrow clearance in the right and left directions are formed on the front and rear portions of said at least one of the guide rail grooves;

between said front and rear play restrict portions, a play portion having a wide clearance in the right and left direction is formed; and in the intermediate portion of said at least one of the guide ribs, there is formed a narrow width portion which, when the rear portion of said at least one of the guide ribs is inserted into said play portion after connection of said two connectors, allows the rear portion of said at least one of the guide ribs to play in the right and left direction with the front portion of said at least one of the guide ribs fitted into said front-side play restrict portion of said at least one of the guide rail grooves as a fulcrum.

3. The on-board unit receiving connector positioning structure as set forth in claim 1, wherein the guide ribs are provided at the right and left positions of the outer surface of said on-board unit;

the guide rail grooves are formed at the right and left positions of the inner surface of said insertion opening of said car-body side panel;

the play restrict portions having a narrow clearance in the vertical direction thereof are formed on the front and rear sides of each of said guide rail grooves;

between said front and rear play restrict portions, a play portion having a wide clearance in the vertical direction thereof is formed; and in the intermediate portion of each of said guide ribs, there is formed a narrow width portion which, when the rear portion of said guide rib is inserted into the associated play portion after connection of said two connectors, allows the rear portion of said guide rib to play in the vertical direction thereof with the front portion of said guide rib fitted into the front-side play restrict portion of the associated guide rail groove as a fulcrum.

4. The on-board unit receiving connector positioning structure as set forth in claim 2, wherein at least one of the guide ribs is disposed at least at one of the upper and lower positions of the outer surface of said on-board unit;

at least one of the guide rail grooves that corresponds in position to the at least one of the guide ribs is formed in the inner surface of the insertion opening of said car-body side panel;

the play restrict portions each having a narrow clearance in the right and left directions are formed on the front and rear portions of said at least one of the guide rail grooves;

between said front and rear play restrict portions, a play portion having a wide clearance in the right and left direction is formed; and in the intermediate portion of said at least one of the guide ribs, there is formed a narrow width portion which, when the rear portion of said at least one of the guide ribs is inserted into said play portion after connection of said two connectors, allows the rear portion of said at least one of the guide ribs to play in the right and left direction with the front portion of said at least one of the guide ribs fitted into said front-side play restrict portion of said at least one of the guide rail grooves as a fulcrum.

* * * * *